United States Patent [19]

Maier

[11] Patent Number: 4,837,888

[45] Date of Patent: Jun. 13, 1989

[54] SUCTION NOZZLE FOR A VACUUM CLEANING DEVICE

[76] Inventor: Siegfried Maier, Grundstrasse 7, D-7022 Leinfelden-Echterdingen 3, Fed. Rep. of Germany

[21] Appl. No.: 65,784

[22] Filed: Jun. 24, 1987

[30] Foreign Application Priority Data

Jun. 26, 1986 [DE] Fed. Rep. of Germany ... 8617077[U]

[51] Int. Cl.[4] ..... A47L 5/10

[52] U.S. Cl. ..... 15/387; 15/375; 15/415 R

[58] Field of Search ..... 15/383, 384, 385, 386, 15/387, 366, 375, 415 R, 416, 421

[56] References Cited

U.S. PATENT DOCUMENTS

| | | | |
|---|---|---|---|
| 2,536,902 | 1/1951 | Beckett | 15/384 |
| 2,703,904 | 3/1955 | De Long | 15/387 |
| 2,930,069 | 3/1960 | Kowalewski | 15/375 |
| 3,150,394 | 9/1964 | Sauers | 15/384 |
| 4,198,727 | 4/1980 | Farmer | 15/400 |
| 4,564,972 | 1/1986 | Varin | 15/415 R |

*Primary Examiner*—Harvey C. Hornsby
*Assistant Examiner*—Corinne M. Reinckens
*Attorney, Agent, or Firm*—Darby & Darby

[57] ABSTRACT

Suction nozzle for use in connection with a vacuum cleaning device for cleaning simultaneously the vertical surface (3) of a plinth (5), which is provided with a textile covering, and the immediately adjacent floor surface (2) likewise provided with a textile flooring. The suction nozzle (1) is provided with two suction openings (7 and 8) arranged approximately perpendicularly relative to each other so that the horizontal suction opening (7) rests on the floor surface (2) to be cleaned while the vertical suction opening (8) is in contact with the vertical surface (3) of the plinth (5). For increasing the cleaning effect, at least one rotating, mechanincally driven brush (5) is provided within the horizontal suction opening (7) and the vertical suction opening (8).

9 Claims, 2 Drawing Sheets

SUCTION NOZZLE FOR A VACUUM CLEANING DEVICE

The present invention relates to a suction nozzle designed for use in connection with a vacuum cleaning device for cleaning simultaneously a horizontal surface and a vertical surface immediately adjacent thereto, as defined by the preamble of claim 1.

When floor surfaces are covered with a textile flooring material, the vertical surface area of the plinth arranged between the horizontal floor area and the vertical wall surface normally is also covered with a textile material, generally the same flooring material as that used for the floor. Normally, the textile flooring material is fixed to the vertical surface of the plinth by gluing. Cleaning the marginal areas along the walls and/or along the plinths is, however, always connected with problems because in spite of the many shapes of suction nozzles available for vacuum cleaning devices, in particular for cleaning the corner areas at the transition between the floor surface and the wall surface, no satisfactory results have been achieved to this day. Not even suction nozzles comprising rotating brushes have succeeded in achieving satisfactory cleaning results. Considering that, normally, floors are walked on rarely in the areas along the wall surfaces, the dirt depositing on these surface areas consists of very fine dust particles which, due to their very small grain size, are no longer picked up and carried away by the air current produced by the suction nozzle. This applies also to the vertical surfaces of splinths provided with textile coverings. Here, too, the extremely fine dust settles in the structure of the textile covering, and this to the same degree as on the horizontal surfaces, since the extremely fine dust particles occur in the form of suspended particles which tend to settle on both, vertical and horizonal surfaces.

Cleaning these vertical surfaces requires a particular operation which cannot be carried out satisfactorily with existing suction nozzles.

Now, it is the object of the present invention to provide a suction nozzle which enables the vertical plinth surface and the immediately adjacent horizontal floor surface to be cleaned in a single operation.

This object is achieved by the present invention as follows:

The suction nozzle is provided with two suction openings arranged vertically relative to each other so that one of the said suction openings rests on the floor in the marginal area thereof, while the other suction opening is in contact with the vertical surface of the plinth.

In order to permit the suction nozzle to be connected detachably to the suction line leading to the vacuum cleaning device, a rotatable coupling sleeve is arranged at the housing part of the suction nozzle opposite the vertical suction opening. The part of the coupling sleeve projecting from the housing portion of the suction nozzle and arranged for receiving the suction line is inclined at an acute angle relative to the rotary axis of the coupling sleeve. In order to enable plinth/floor areas to be cleaned optionally from "the right" or from "the left", the part of the suction nozzle housing receiving the rotatable coupling sleeve is arranged for rotation about a rotary axis, in parallel to the floor surface. As the air current drawn in through the suction openings of the suction nozzle cannot alone pick up the fine dust deposited on the horizontal floor surface and the vertical plinth surface, a mechanically driven rotating brush is arranged in the housing of the suction nozzle. The bristles of the brush project through the vertical and horizontal suction openings and act upon the surfaces to be cleaned during the cleaning process. Alternatively, it is also possible to drive the rotating brush through the reciprocating movement of the suction nozzle during operation, via a "friction wheel" engaging the floor surface or the splinth surface. According to another alternative, the single rotating brush provided within the housing part of the suction nozzle may be replaced by two rotating brushes arranged in the two suction openings.

The suction openings of the suction nozzle are provided in the conventional manner with sliding surfaces by which the suction nozzle is in contact with the surfaces to be cleaned during operation.

For transmitting the rotary movement to the rotating brushes, an intermediate gear may be provided between the drive element and the brush or brushes, whether a "friction wheel" or an air turbine is used as driving means.

One embodiment of the invention is shown in the drawing in which.

Figure 1:
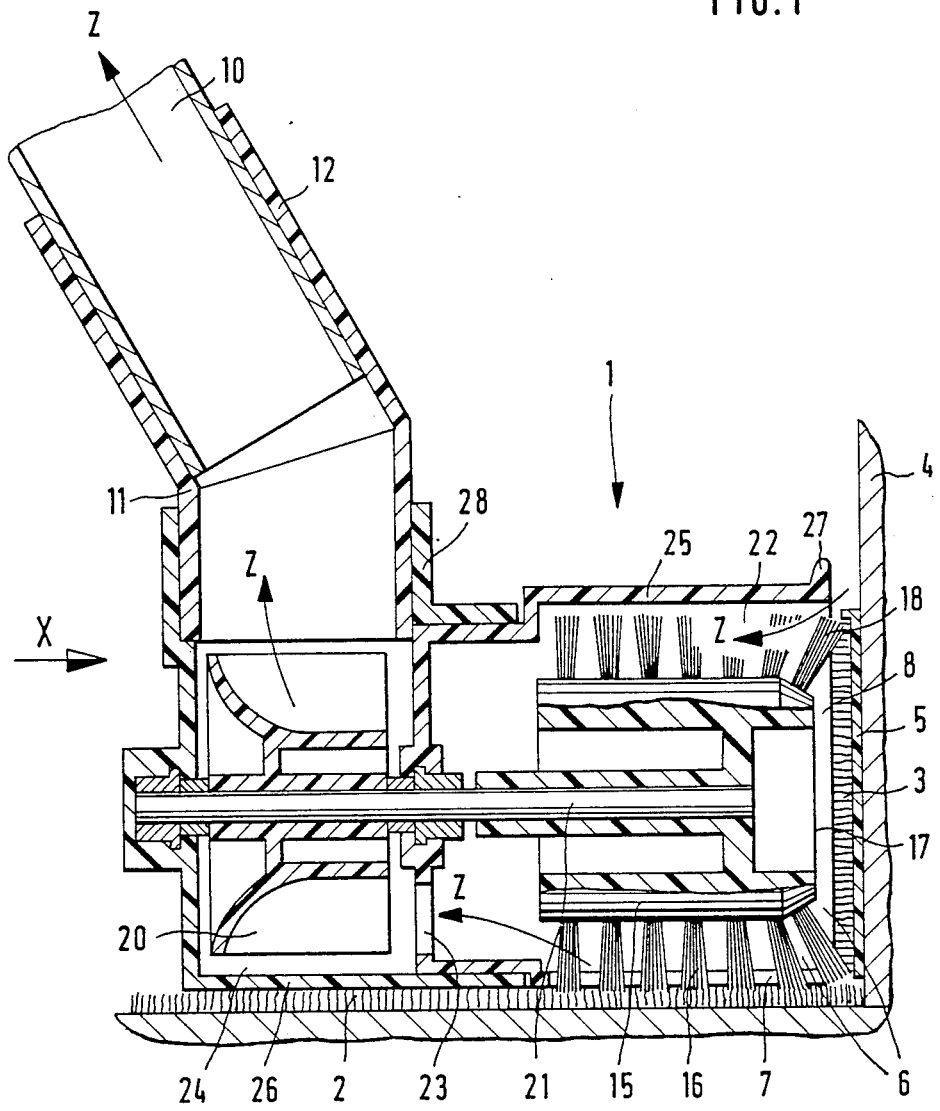
FIG. 1 is a vertical cross-section through the suction nozzle in the operating condition, and in the position in which it is in contact with the floor surface and the wall surface.

Reference numeral 1 generally designates the suction nozzle which in the operating condition is in contact simultaneously with the horizontal floor surface 2 to be cleaned and the vertical surface 3 of a plinth 5 on a vertical wall 4, which also is to be cleaned, so that the corner area 6 formed between the floor surface 2 and the wall surface 4 of the plinth 5 is covered up by the horizontal suction opening 7 and the vertical suction opening 8 of the suction nozzle 1. A vacuum cleaning device—not shown in the drawing—is connected to the suction nozzle 1 via a suction line 10 which is coupled to the latter detachably by means of a coupling sleeve 11. The air current generated by the vacuum cleaning device is drawn in through the horizontal suction opening 7 and the vertical suction opening 8 in the suction nozzle 1 and fed to the vacuum cleaning device via the coupling sleeve 11 and the suction line 10. In operation, the suction nozzle is moved to and fro while being in contact with the floor 2 and the vertical surface 3 of the plinth 5. The part of the suction line 10 connected with the coupling sleeve is designed as a rigid handle for this purpose. Considering that, generally, the dirt encountered in the corner area 6 formed between the floor surface 2 and the adjacent plinth surface 5 consists only of very fine dust that had been suspended in the air of the room, it is necessary to pick up these very fine dust particles mechanically, preferably by means of a brush, so that they can be entrained by the suction current and fed to the vacuum cleaning device.

Since fixed bristles provided on the suction nozzle 1 in the areas of the suction openings 7 and 8 would increase the sliding resistance excessively, or even block any movement of the suction nozzle, depending on the type of the flooring material to be cleaning, it is necessary that the brushing operation be carried out by means of a rotating brush. To this end, the suction nozzle 1 encloses a rotating, roller-shaped brush 15 whith tufts of bristles 16 and 18 arranged in parallel to its longitudinal axis and also on its end face 17 extending perpendicularly thereto. The roller-shaped brush 15 is arranged within the suction nozzle 1 in such a manner that the bristles 16 project through the horizontal suction opening 7 facing the floor surface 2 so as to engage the flooring material on the floor surface 2, while the bristles 18 arranged on the end face 17 of the roller-shaped brush 15 project through the vertical suction opening 5 so as to engage the flooring material on the vertical surface 3 of the plinth 5. In the case of the described embodiment, the rotating roller-shaped brush 15 is driven by an air turbine 20 which in this case is fixed to the shaft 21 of the roller-shaped brush 15 to rotate therewith. The air current produced by the vacuum cleaning device—and not shown in the drawing—is drawn into the space 22 of the suction nozzle 1 accommodating the brushes, and further through the guide opening 23 to the air turbine 20 mounted on the shaft 21 in the turbine space 24. Leaving the turbine space 24, the air current flows through the coupling sleeve 11 and the suction line 10 into the vacuum cleaning device where the dust contained in the air current is retained by filtering means and collected in the conventional manner. The brush housing 25 which encloses the rotating roller-shaped brush 15 and which is provided with the horizontal and vertical suction openings 7 and 8, is further provided—in the areas of the said openings—with a horizontal sliding face 26 and a vertical sliding face 27 by which the suction nozzle 1 is in sliding contact with the surfaces to be cleaned and which, therefore, form the two sliding faces of the nozzle arranged perpendicularly to each other. In order to enable the reciprocating working movement to be adapted optimally to the existing local conditions and the user's manner of working, the coupling sleevre 11 is designed to permit full rotation, and the portion receiving the suction line 10 is inclined at an acute angle relative to the axis of rotation.

Figure 2:
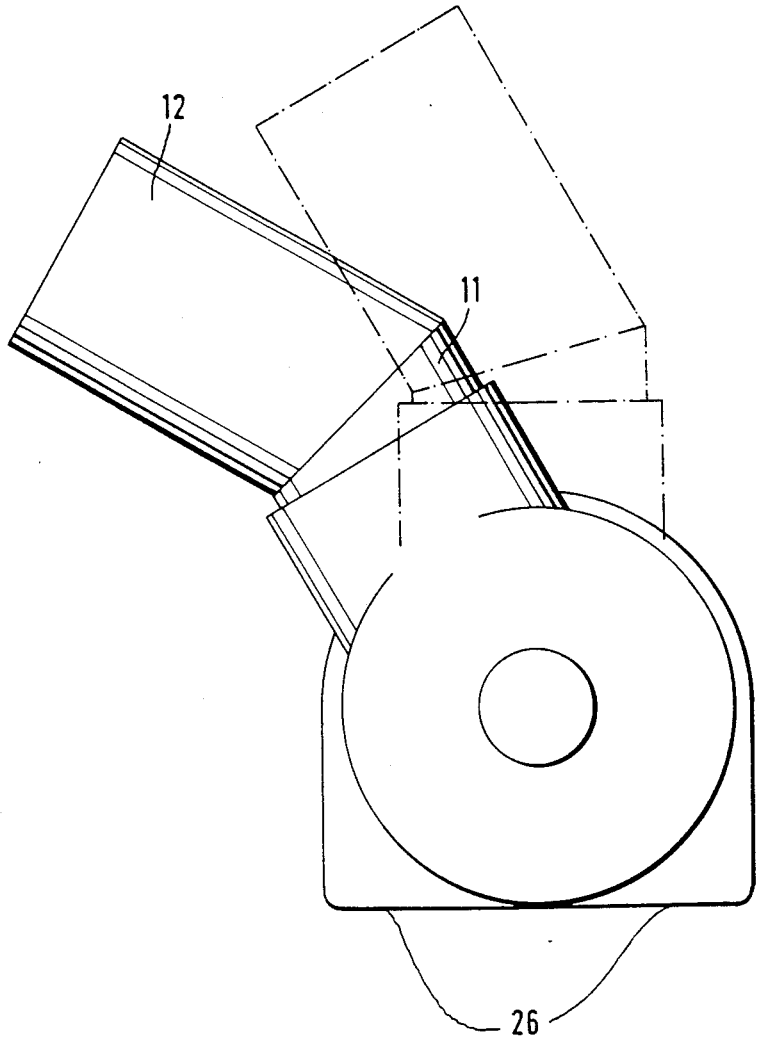
FIG. 2 is a side view of the suction nozzle, viewed in the direction "X".

The turbine housing 28 receiving the coupling sleeve 11 is seated rotatably in the brush housing 25 so that the suction line 10, which takes the form of a guide handle, may be inclined at any angle relative to the floor surface, as can be seen very clearly in FIG. 2. That is, the coupling sleeve 11 is offset at an angle with respect to the bottom or sliding face 26 as shown in FIG. 2. Moreover, the upper section 12 of the sleeve 11 is at an acute angle to the lower portion. Thus, as the sleeve 11 is rotated the angle handle or line 10 makes with the floor changes.

Instead of providing a roller-shaped brush 15 whose axis of rotation extends parallel to the floor surface and whose bristles project through both, the horizontal and the vertical suction openings, it is also possible to arrange the axis of rotation of the roller-shaped brush at any other angle in such a manner that the bristles of the brush project through both, the horizontal and the vertical suction openings 7 and 8. In this latter case, the outer contour of the bristles must be shaped correspondingly.

According to another embodiment of the invention, two roller-shaped rotating brushes are used instead of the single roller-shaped brush 15, each of the said two rotating brushes being associated with one of the suction openings. According to still another embodiment of the invention, the rotating roller-shaped brush or roller-shaped brushes are driven by the reciprocating movement of the suction nozzle during operation due to the fact that drive wheels having their wheel rims provided with a friction lining engage the floor covering or the plinth covering and that their rolling movement is transmitted to the rotating brushes via an intermediate gear.

I claim:

1. A nozzle for use with a vacuum cleaning device, said nozzle being adapted to be detachably connected to a vacuum cleaning device through a suction line, characterized in that said nozzle comprises a housing having a bottom wall and a side wall, said bottom wall having a bottom opening and said side wall having a side opening through which dirt enters the housing when the vacuum cleaning device is operable; brush means in said housing, said brush means comprising a single brush support having a first set of radially extending bristles extending along the length thereof and projecting through said bottom opening for engaging the floor, and a second set of bristles connected to an end of said brush support and at an angle thereto extending through said side opening for engaging a sidewall to be cleaned; said brush means including a shaft for rotating said brush support; and drive means connected with said shaft along the said axis of rotation for rotating said brush support.

2. A nozzle as in claim 1, in which said side opening and said bottom opening are perpendicular to each other, said second set of bristles projecting through said side opening being positioned to engage the vertical surface of a plinth.

3. A nozzle as in claim 1, in which said housing includes sliding surfaces adjacent said bottom opening and said side opening whereby said nozzle is in sliding contact with the surfaces to be cleaned.

4. A nozzle as in claim 1, in which and said drive means comprises an air turbine affixed to said shaft and received within said housing; said housing defining an air flow path from said bottom and side openings, through said housing and the suction line, to the vacuum cleaning device; said air turbine being positioned in the air flow path.

5. A nozzle as in claim 1, in which said housing includes a coupling sleeve adapted to be detachably connected with the suction line.

6. A nozzle as in claim 5, in which said coupling sleeve is rotatable about its longitudinal axis.

7. A nozzle as in claim 6, in which the upper portion of said coupling sleeve extends at an acute angle with respect to the lower portion thereof.

8. A nozzle as in claim 6, in which said housing includes a first portion pivotable about an axis substantially parallel to the floor on which said nozzle is adapted to stand, said first portion rotatably receiving said coupling means therein.

9. A suction nozzle as in claim 1, in which said brush means includes a shaft rotatable about an axis extending approximately parallel to the floor surface on which said nozzle is adapted to stand.

* * * * *